United States Patent [19]

Grunder

[11] 4,438,548

[45] Mar. 27, 1984

[54] METHOD AND APPARATUS FOR CONTROLLING FLUCTUATIONS IN SLIVER WEIGHT ON CARDS, CARDING MACHINES AND THE LIKE

[75] Inventor: Werner Grunder, Moenchaltorf, Switzerland

[73] Assignee: Zellweger Uster Ltd., Uster, Switzerland

[21] Appl. No.: 293,221

[22] PCT Filed: Sep. 30, 1980

[86] PCT No.: PCT/CH80/00117

§ 371 Date: Aug. 7, 1981

§ 102(e) Date: Aug. 7, 1981

[87] PCT Pub. No.: WO81/02029

PCT Pub. Date: Jul. 23, 1981

[30] Foreign Application Priority Data

Jan. 17, 1980 [CH] Switzerland ..... 392/80

[51] Int. Cl.[3] ..... D01H 5/38

[52] U.S. Cl. ..... 19/105; 19/106 R; 19/240; 19/300

[58] Field of Search ..... 19/105, 106 R, 65 A, 19/300, 240

[56] References Cited

U.S. PATENT DOCUMENTS

| | | | |
|---|---|---|---|
| 3,435,673 | 4/1969 | Felix | 73/160 |
| 4,161,052 | 7/1979 | Erben | 19/105 X |
| 4,257,147 | 3/1981 | Moss | 19/105 X |
| 4,271,565 | 6/1981 | Grunder | 19/106 R |

FOREIGN PATENT DOCUMENTS

| | | | |
|---|---|---|---|
| 1266189 | 4/1968 | Fed. Rep. of Germany . | |
| 1921248 | 2/1970 | Fed. Rep. of Germany . | |
| 2113140 | 9/1972 | Fed. Rep. of Germany . | |
| WO81/02029 | 7/1981 | PCT Int'l Appl. | 19/106 R |
| 1140661 | 1/1969 | United Kingdom . | |

*Primary Examiner*—Louis Rimrodt

*Attorney, Agent, or Firm*—Antonelli, Terry & Wands

[57] ABSTRACT

A regulation of the density of the fibre clothing on cards, carding engines and the like is described which is based on measuring the torque which has to be used for the drive of the licker-in or the cylinder. The signal corresponding to this torque is compared with a desired value which is either arbitrarily adjustable or is obtained from a sliver count measuring member or constitutes a combination of the two.

The torque is either measured by measuring the power consumption for the drive of the licker-in and/or the cylinder, or by measuring the torsion of a torsion shaft, or by measuring the slip occurring in a variable coupling.

16 Claims, 5 Drawing Figures

METHOD AND APPARATUS FOR CONTROLLING FLUCTUATIONS IN SLIVER WEIGHT ON CARDS, CARDING MACHINES AND THE LIKE

BACKGROUND OF THE INVENTION

The production of slivers and webs which are as regular as possible in cross section is very significant in the textile industry. Slivers and webs of this type are mostly produced on cards or on carding engines. A large number of methods and apparatus for automatically controlling the fiber supply to these machines is known for achieving the required regularity.

A known method, such as that disclosed in U.S. Pat. No. 3,435,673, comprises measuring the cross section of the issuing slivers and controlling the speed of the feed roller of the card based on the measured values obtained, such that even when the density of the fiber feed varies, just enough material is always supplied, per unit of time, to the card as is required for maintaining a constant cross section in the material drawn off. This method is relatively slow due to the long fiber transport path between the positioning point (feed roller) and the measuring point at the draw-off rollers. Fluctuations which are shorter than this transport path cannot be regulated, because they have already passed the positioning point at the time of their metrological detection. It is only possible to accelerate this method by bringing the measuring point closer to the positioning point. However, an absolute measuring member is not known from the present prior art which may be mounted downstream of the feed roller in an optimum vicinity and which simultaneously has the precision required for the purpose of use.

Another known method, such as that disclosed in U.S. Pat. No. 4,271,565, solves this problem in that in addition to positioning the absolute measuring member at the draw-off rollers, another measuring member is positioned at the lickerin, or at the cylinder, or at the doffer, or at the doffer rollers, or at the web, which must only recognize variations in the fiber throughput, but not the absolute amount thereof. Measuring members of this type may also be produced from the present prior art. In the combination mentioned with a precise absolute measuring member, they allow the desired acceleration in the control procedure even with a relatively low precision.

A known measuring member belonging to this category measures variations in the fiber throughput by an optical determination of the density of the fiber clothing, for example on the cylinder. The method is based on the fact that, for example, a lightly colored fiber clothing reflects more light with an increasing density than the dark background formed, for example, by the cylinder clothing. This measuring member does indeed constitute substantial technical progress. However, the necessary difference in the reflection characteristics of the fiber clothing and the background implies a restriction in the practicability. A further restriction is the decreasing precision where there is a poor fiber resolution. For example, this obstructs optimum use of this measuring member at the licker-in although the licker-in would be the optimum measuring point from the control point of view, for the card feed control with a closed-control loop.

SUMMARY OF THE INVENTION

The present invention relates to a method and an apparatus having the same purpose of use as the above-noted optical measuring member, but without its previously described restrictions. Thereby, the previously described card feed control may be effected more rapidly, more precisely and more broadly using a closed-control loop than was possible with the hitherto known techniques.

The method according to the invention is based on the fact that the torque of the licker-in drive is measured and a signal corresponding to this torque is used as a control characteristic for the regulation of the feed speed of the card. Since a substantial part of the licker-in torque depends on the quantity of material supplied to the licker-in per revolution, variations in this torque may be used as a measurement for the fluctuations in cross section of the fiber feed which are to be balanced. In order to balance such fluctuations in the simplest case, the speed of the feed roller merely needs to be regulated so that the torque of the licker-in remains constant, i.e. the licker-in operates at a constant speed with a constant drawing power. As far as the drawing power substantially depends only on the quantity of material supplied per unit of time, which at least applies within a restricted period of time, while disregarding short power peaks where the material and the drawing power are constant, then this means that a constant quantity of fiber is continuously supplied to the card per unit of time, at least within the restricted time interval mentioned. Since this quantity of fiber is drawn off at a constant speed from the card as a sliver, the cross-section of the sliver also remains constant. The purpose of the control operation is thereby achieved.

Since changes in the feed roller speed practically result without delay when the drawing power at the licker-in is changed, the control procedure may also be carried out practically without delay. As a result of this measure, extremely short feed fluctuations may also be balanced.

Over longer periods of time, the drawing power of the licker-in does not generally depend only on the material throughput, but a varying preliminary opening of the fibers, a varying brightening application and differences in moisture etc., may also considerably influence the specific drawing power. Moreover, the licker-in also requires considerable idling torque independent of the drawing power in order to overcome the bearing friction and the air resistance, whereby in this case as well, fluctuations are to be reckoned with during longer periods of time. However, in order to also be able to achieve a precise regulation over long periods of time, the torque measurement at the licker-in is therefore advantageously combined with an absolute measuring member at the drawing-off point from the card, which is suitable for correcting long period inaccuracies in the torque measurement.

The torque measuring method may also be used in the same manner on the cylinder, in which case, the carding power of the flat is recorded and not the drawing power. Since the carding power also increases when the fiber clothing increases on the cylinder, the cross section of the clothing on the cylinder may be regulated as a result of this and thus finally also the sliver count. Long period differences are also advantageously corrected in this case by a combination with an absolute measuring member at the drawing-off point from the card.

A modified method is also conceivable, in which the control signal is obtained from the torque behavior of the feed roller. The feed operation of the lap into the card requires a torque which increases when the thickness of the lap increases. The required constant fiber throughput may then be achieved by an opposite regulation of the speed of the feed roller. This method may also be combined with the direct sliver measurement which has already been described.

The apparatus according to the invention for implementing the method substantially consists of a device for measuring the torque at the licker-in, or at the cylinder, or at the common drive of these two elements and of a feed regulation of the card known per se with a closed control loop.

Embodiments of the invention will now be explained in detail, with reference to the description and the Figures.

FIG. 1 schematically illustrates a card with a control device,

Figure 1:
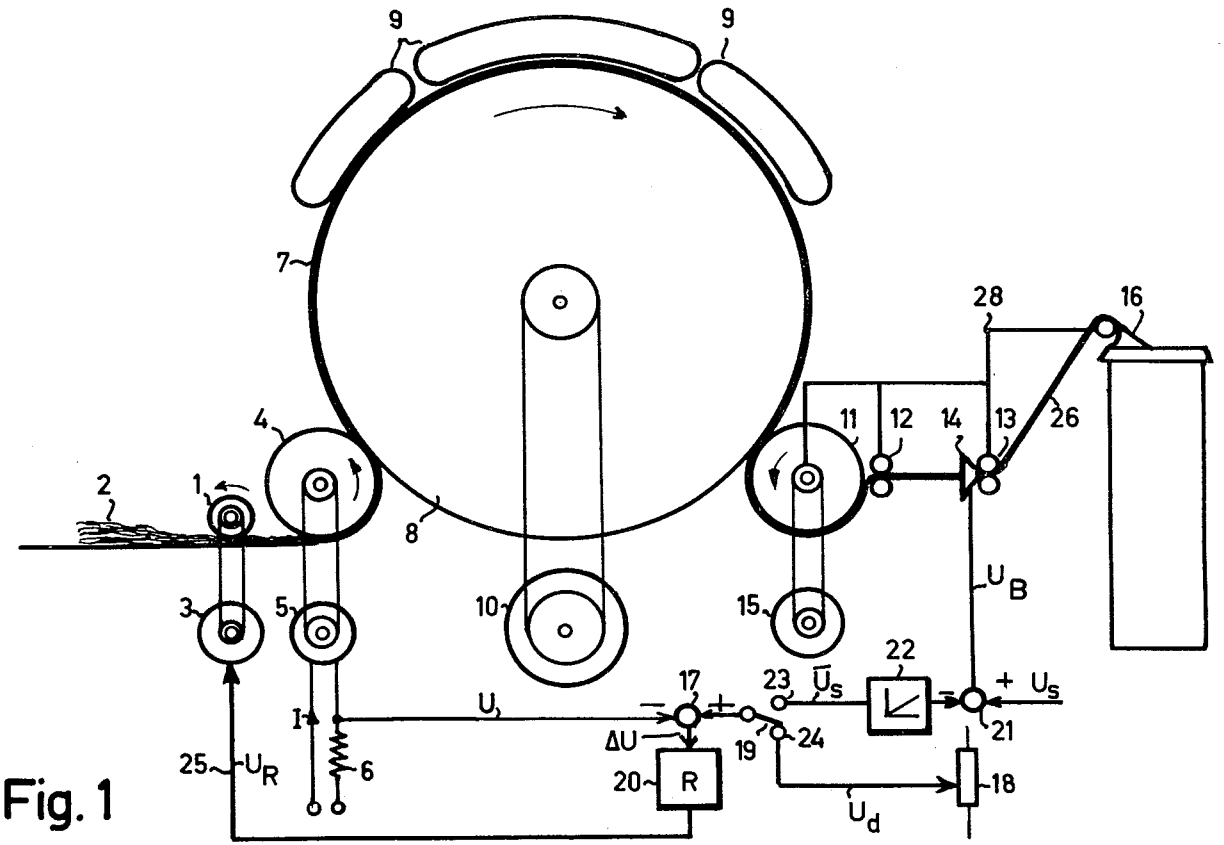
Figure 2:
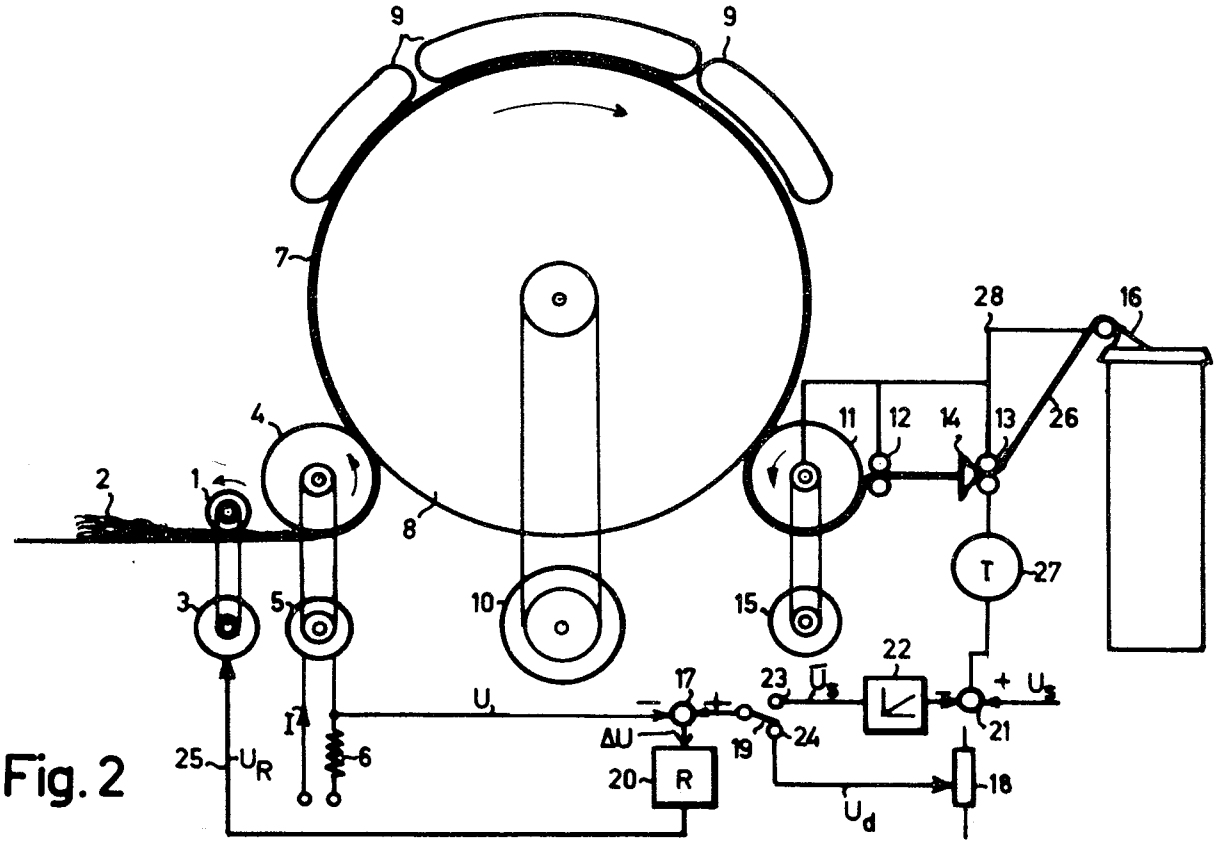
FIG. 2 illustrates a card with a first variation of the control device.
Figure 3:
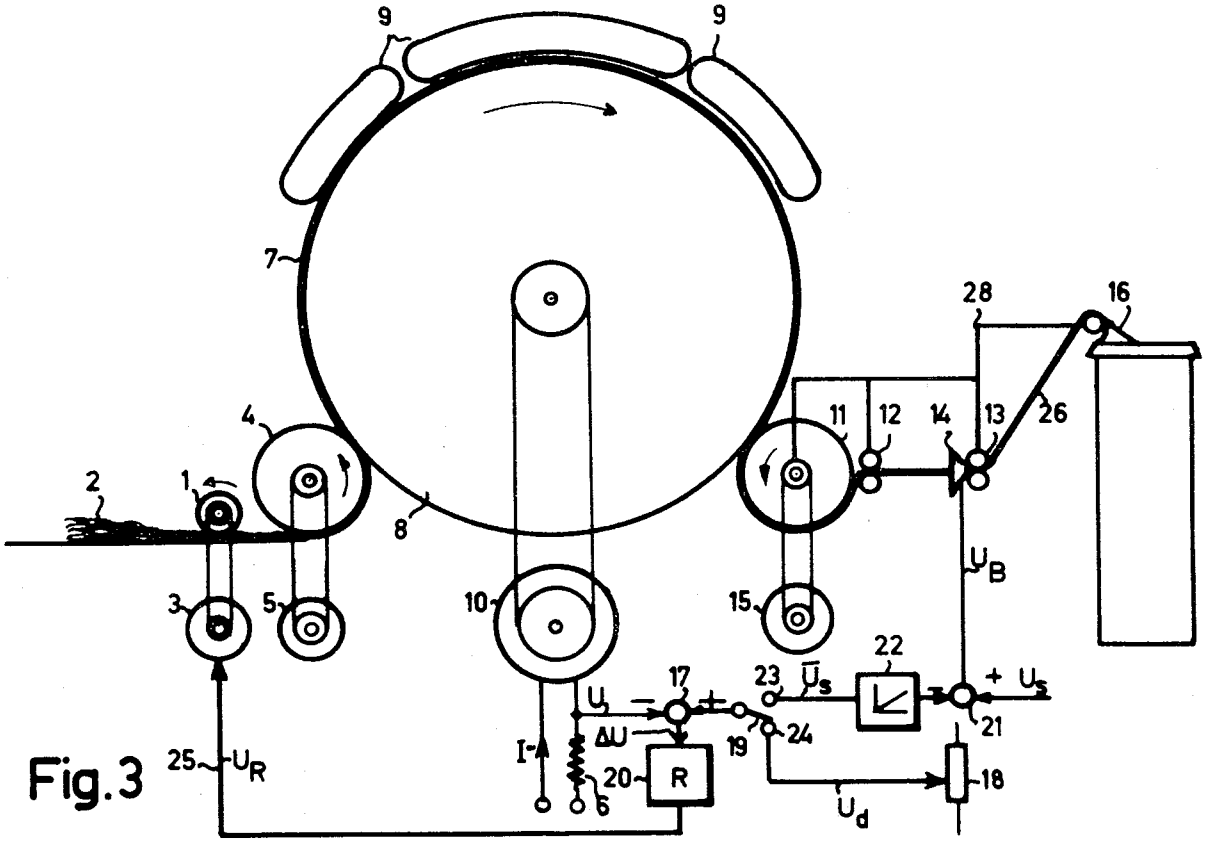
FIG. 3 illustrates a card with a second variation of the control device.

The card illustrated schematically in FIGS. 1 to 3 consists in an arrangement known per se of a feed roller 1, to which the fibrous material is fed, a licker-in 4, a cylinder 8 with a fiber clothing 7 and flats 9, a doffer 11 with doffer rollers 12, a calender part 13 and a can coiler 16. For a clearer illustration, the individual rotation bodies are illustrated with individual drives, namely the drawing-in roller 1 with a motor 3, the licker-in 4 with a motor 5, the cylinder 8 with a motor 10, and the doffer 11 with a motor 15. The calender part 13 and the can coiler 16 are driven by the doffer 11 via a mechanical connection 28.

In the first embodiment, according to FIG. 1, the torque of the licker-in 4 is measured by means of the current composition of the motor 5. In the case of a direct current motor, the current is proportional to the torque; where there is an alternating current motor, the current is $I \times \cos \phi$ proportional to the torque.

The motor current I is converted into a proportional voltage U by means of a measuring resistor 6 and it is compared with a desired value voltage at a first summing point 17. The difference $\Delta U$ resulting from this comparison is converted in a control member 20 into a control signal $U_R$ for the speed of the motor 3 or of the feed roller 1. A torque which is too high means that the fiber clothing is too thick, thus the speed of the feed roller 1 has to be reduced, whereas a torque which is too low requires an increase in the speed of the feed roller 1, and this applies to both conditions until the difference $\Delta U$ between the measuring voltage and the desired value disappears.

In a simple embodiment of the apparatus, the desired value conveyed to the controller 20 may, for example, be a voltage Ud which is firmly adjusted at a desired value resistor 18. This voltage Ud passes via a terminal 24 of a change-over switch 19 to the first summing point 17. However, the card fitted with the apparatus only delivers a sliver with a constant cross-section as long as the proportionality factors between the torque of the licker-in 4 and the count of the sliver 26 do not change. A variable proportionality factor of this type is, for example, the material-dependent ratio between the material supply and the drawing power of the licker-in 4, or also the adjustable ratio of the licker-in speed and the delivery speed.

In an improved embodiment, the switch 19 is connected to a terminal 23. A desired value $U_S$ derived from the count of the sliver 26 is applied to this terminal 23. A signal $U_B$ corresponding to the sliver count is produced in a sliver measuring member 14 and is conveyed to a second summing point 21 where it is compared with a desired value $U_S$ for the sliver count. The differential signal produced therefrom passes through an integrator 22 whose output signal Us forms the desired value for the licker-in torque at the summing point 17. The advantage of this arrangement is that the rapidly changing material supply may be balanced by the rapidly reacting torque regulation, whereas the second slow control loop only needs to remove the slowly changing disturbance factors.

The two embodiments which have been described here explain the basic principles of the desired value pre-determination for the controller 20. It may be very sensible to combine together several fixed and/or variable desired value pre-determinations, for example by an additive superpositioning, in order to compensate, for example, the idling torque of the licker-in 4 or to optimize the behavior of the regulation where there are varying operational conditions (e.g. during the starting-up action of the card).

The card which is fitted with the device in the embodiment described is preferably driven by the four individual drives 3, 5, 10 and 15. In this arrangement, the drives 5 and 10 must be synchronized together for an orderly operation of the card. The doffing side of the card (motor 15) is usually also synchronized with the motors 5 and 10; however, it may usually also be stopped separately or operated at slow speed. In order to protect the card from an overfeed in such an operating condition, additional precautions in terms of the apparatus are to be provided. For example, it is possible for the doffing speed to be continuously measured and in such an extraordinary operating condition (e.g. also when the card starts up and slows down), either for the desired torque for the controller 20 to be reduced corresponding to the doffing speed or for the speed of motor 3 to be synchronized with that of motor 15. This is illustrated in FIG. 2, where a tacho-generator 27 is coupled with a rotating part defining the sliver drawing-off speed, for example, the calender rollers 13. The signal UT corresponding to the tacho-speed is predetermined in these cases as the desired value.

FIG. 3 illustrates, as another variation, the torque or the power of the cylinder drive is evaluated, in that the current consumption of the motor 10 is determined by the precision resistor 6 and is used for a comparison with the desired value. The flats 9 exert a torque on the rotation cylinder 8, which torque increases when the thickness of the fiber clothing 7 increases on the cylinder. The apparatus used in this manner therefore primarily acts as a density controller for the fibre clothing on the cylinder 8. However, the sliver count is also finally regulated as a result of this operation.

Figure 4:
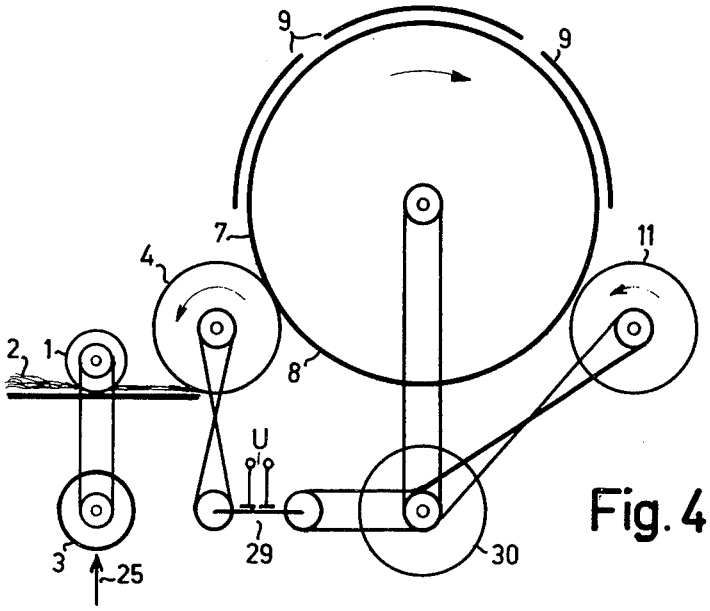
FIG. 4 illustrates details of a third variation.
Figure 5:
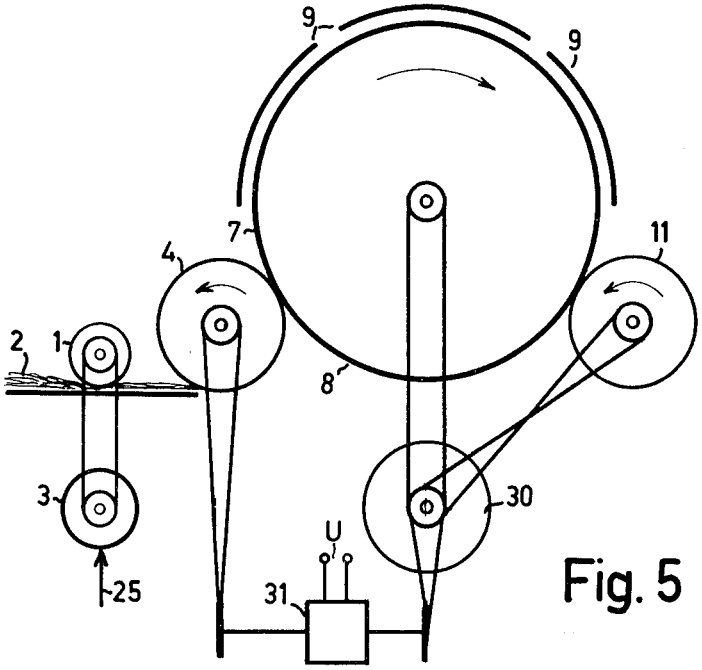
FIG. 5 illustrates details of a fourth variation of the control device.

The torque measurement of a rotating part of the card, the carding engine or the like may also be effected in a manner other than by measuring the power consumption. For example, it is possible to design the driving shaft for the licker-in 4, or for the cylinder 8 as a torque rod 29, in that the torsion thereof is measured and is converted into a corresponding signal. In this case, the drives for the licker-in 4, the cylinder 8 and the doffer 11 may be effected by a common motor 30 as is illustrated in FIG. 4.

Another possibility of measuring the torques for the driven cylinders of the card consists in the arrangement of a variable coupling 31 between the motor 30 and the relevant shaft. For this purpose, the size of the slip between the drive and the driven axle or the excitation of the variable coupling 31 required for a non-slip transmission is to be measured as a control signal and the difference is to be formed therefrom with a corresponding desired value, as this was previously described.

I claim:

1. A method for controlling fluctuations in sliver weight on a device for processing a fiber sliver, wherein a fibrous material is fed to a card, or the like and is withdrawn as a sliver, comprising the steps of measuring the torque or the power of at least one rotating part of the card, or the like, upon which a fiber material is leveled and distributed and producing a control signal indicative thereof; and controlling the rate at which said fibrous material is fed as a function of said control signal in a manner that said torque, or said power, is held to a control value.

2. A method according to claim 1, wherein said control value is adjusted during processing.

3. A method according to claim 1 or 2, wherein said control value is determined by at least one other measuring operation.

4. A method according to claim 1, wherein the torque or the power of a licker-in is measured to produce the control signal.

5. A method according to claim 1, wherein the torque or the power of a cylinder is measured to produce the control signal.

6. A method according to claim 1, wherein the torque or the power of a feed roller is measured to produce the control signal.

7. A method according to claim 1, wherein the torque or the power of a licker-in and a cylinder are measured and the total of the torques or the power of the licker-in and the cylinder is used to produce the control signal.

8. A system for controlling fluctuations in sliver weight on a device for processing fiber sliver of the type, wherein a fibrous material is fed by a feed roller to a card, or the like and is withdrawn as a sliver, comprising means for measuring the torque or power of at least one rotating part of the card, or the like and producing an output indicative thereof, a controllable drive for the feed roller, and a controller interconnected between said means for measuring and said controllable drive so as to control the speed of the feed roller so as to feed said fibrous material in a manner that said torque, or said power is held to a control value.

9. A system according to claim 8, wherein said means for measuring comprises a power meter associated with a driving motor for the at least one rotating part for determining the torque or the power thereof.

10. A system according to claim 8, wherein said means for measuring comprises a mechanical torsion meter.

11. A system according to claim 10, wherein said torsion meter comprises a drive shaft constructed as a torque rod.

12. A system according to claim 8, wherein the means for measuring comprises an inductive transmitter.

13. A system according to claim 12, wherein the inductive transmitter comprises an inductively-acting slip coupling between a driving motor and driving shaft of the at least one rotating part.

14. A system according to claim 8, comprising at least one adjusting controller for feeding in said control value for the torque to the controller for the feed roller.

15. A system according to claim 14, comprising at least one measuring member for determining the sliver thickness, the output of said measuring member being fed to said adjusting controller, for said control value.

16. A system according to claim 14, comprising a tacho-generator at delivery members of the card, carding engine or the like for obtaining a control signal corresponding to the delivery speed, the delivery speed control signal being fed to said adjusting controller for determining said control value.

* * * * *